US010183207B2

(12) United States Patent
Mesplay

(10) Patent No.: US 10,183,207 B2
(45) Date of Patent: Jan. 22, 2019

(54) INTERCHANGEABLE SPORTS BALL KICKING TRAINING APPARATUS

(71) Applicant: Ronald Mesplay, Lake Mary, FL (US)

(72) Inventor: Ronald Mesplay, Lake Mary, FL (US)

( * ) Notice: Subject to any disclaimer, the term of this patent is extended or adjusted under 35 U.S.C. 154(b) by 0 days.

(21) Appl. No.: 15/689,832

(22) Filed: Aug. 29, 2017

(65) Prior Publication Data

US 2018/0056161 A1 Mar. 1, 2018

Related U.S. Application Data

(60) Provisional application No. 62/381,274, filed on Aug. 30, 2016.

(51) Int. Cl.

*A63B 69/00* (2006.01)
*A63B 43/00* (2006.01)
*A63B 41/00* (2006.01)

(52) U.S. Cl.

CPC ..... *A63B 69/0091* (2013.01); *A63B 41/00* (2013.01); *A63B 43/002* (2013.01); *A63B 69/002* (2013.01); *A63B 69/0075* (2013.01); *A63B 2209/00* (2013.01); *A63B 2209/08* (2013.01); *A63B 2225/09* (2013.01); *A63B 2225/093* (2013.01); *A63B 2243/007* (2013.01); *A63B 2243/0025* (2013.01)

(58) Field of Classification Search

CPC ..... A63B 41/00; A63B 43/002; A63B 69/002; A63B 69/0075; A63B 2209/00; A63B 2209/08; A63B 2225/09; A63B 2225/093; A63B 2243/0025; A63B 2243/007; A63B 69/0091

USPC ..... 473/422, 438, 446, 423, 429, 430

See application file for complete search history.

(56) References Cited

U.S. PATENT DOCUMENTS 2,767,985 A * 10/1956 Maxcey, Jr. ..... A63B 47/002 473/438
3,439,916 A * 4/1969 Kopp ..... A63B 69/0075 473/419
4,247,117 A 1/1981 Reichert
4,278,257 A * 7/1981 Garcia ..... A63B 69/0079 473/423
4,307,888 A * 12/1981 Ohle ..... A63B 69/0091 473/429
4,462,599 A * 7/1984 Brown ..... A63B 69/0079 473/430

(Continued)

*Primary Examiner* — Mitra Aryanpour

(74) *Attorney, Agent, or Firm* — Global Intellectual Property Agency, LLC; Daniel Boudwin

(57) ABSTRACT

An interchangeable sports training apparatus for training user's how to kick sports balls. The apparatus includes a base including a mounting bracket for mounting the base onto a surface. A height-adjustable support arm affixed to the base includes a swivel rotatably coupled thereto, such that the swivel is configured to rotate 360 degrees about the support arm. A swing arm coupled to the swivel includes a quick-release mechanism configured to releasably engage a sports ball retaining bracket and a first fastener. A height-adjustable return arm includes a second fastener configured to releasably engage the first fastener of the swing arm, in order to hold the training apparatus in a ready position for kicking, and includes a return member configured to stop rotation of the swing arm and return the swing arm to the ready position.

20 Claims, 9 Drawing Sheets

(56) References Cited

U.S. PATENT DOCUMENTS 4,576,379 A * 3/1986 Juhasz ..... A63B 69/0079 473/430
4,616,834 A * 10/1986 Davis ..... A63B 69/0091 473/429
4,647,042 A * 3/1987 Bruce ..... A63B 69/0079 473/430
4,687,209 A 8/1987 Carey
4,706,964 A * 11/1987 Genovese ..... A63B 69/0079 473/430
4,881,742 A * 11/1989 Hargreave ..... A63B 69/0091 473/575
4,906,001 A * 3/1990 Vaughn ..... A63B 69/0075 473/438
5,060,946 A * 10/1991 Taylor ..... A63B 69/0079 473/429
5,238,251 A * 8/1993 Staka ..... A63B 69/0095 473/429
5,398,940 A * 3/1995 Derst, III ..... A63B 69/0079 473/430
5,435,572 A * 7/1995 Covel ..... A63B 69/002 473/423
5,553,848 A * 9/1996 Amron ..... A63B 69/0002 473/416
6,099,419 A 8/2000 Incaudo et al.
6,168,539 B1 1/2001 Maina
6,458,037 B1 * 10/2002 Dixon, Jr. ..... A63B 69/0002 473/219
6,475,108 B1 * 11/2002 Sarenana, Sr. ..... A63B 69/002 273/127 R
6,575,852 B2 * 6/2003 Orner ..... A63B 69/407 124/36
7,056,236 B2 * 6/2006 Ohle ..... A63B 69/002 473/422
7,226,373 B2 * 6/2007 Arenas ..... A63B 69/0002 473/417
7,775,912 B2 * 8/2010 Aguirre ..... A63B 69/002 473/423
7,806,787 B1 * 10/2010 Gamboa ..... A63B 69/00 473/438
7,811,183 B1 * 10/2010 Ohle ..... A63B 69/002 473/420
7,935,006 B2 5/2011 Maina
8,777,781 B2 * 7/2014 Marks ..... A63B 69/002 473/420
8,900,075 B2 * 12/2014 Gu ..... A63B 69/0002 473/422
8,998,751 B2 * 4/2015 Ragen ..... A63B 69/002 473/419
9,283,458 B2 * 3/2016 Achkar ..... A63B 69/002 473/446
9,403,075 B1 * 8/2016 Morgan ..... A63B 69/002 473/446
2006/0189417 A1 8/2006 Evans et al.

* cited by examiner

INTERCHANGEABLE SPORTS BALL KICKING TRAINING APPARATUS

CROSS REFERENCE TO RELATED APPLICATIONS

This application claims the benefit of U.S. Provisional Application No. 62/381,274 filed on Aug. 30, 2016. The above identified patent application is herein incorporated by reference in its entirety to provide continuity of disclosure.

BACKGROUND OF THE INVENTION

The present invention relates to sports training apparatuses for facilitating the teaching of kicking mechanics. More specifically, the present invention relates to a sports training apparatus configured to interchangeably receive a variety of sports balls and facilitate the kicking thereof, and including a means to adjust a sports ball in a desired position and automatically return and suspend the sports ball in a ready position after being kicked.

Athletic training often requires an athlete to perform repetitive tasks directed towards mastering a movement, increasing skill, and improving performance. In sports that use a ball, at least some of the repetitive tasks include striking the ball with a part of the body such as a foot or a piece of equipment such as a bat or a hockey stick. Traditionally, this type of practice requires the use of multiple balls in succession, otherwise the training becomes inefficient as each time a ball is struck it must be recovered before it can be struck again.

Many different solutions have been utilized in an attempt to solve this problem, such as using nets to capture balls that have been kicked, hit, or otherwise struck to prevent them from traveling too far from the user. Though an improvement, it is still necessary for the user to collect and reset the ball in place before the ball can be struck again. Another solution involves the use of practice balls that are designed to limit their flight through the air after being struck. A drawback of these types of practice balls is that they commonly do not completely simulate the effects of striking a normal ball and as a result provide limited feedback. Yet another solution involves attaching a tether to a normal ball so that ball flight can be limited to the distance of the tether. Although more effective than using a practice ball, a drawback of using a tether with a ball such as a soccer ball or a football is that the ball must still be recovered and placed back into a position so that it may be kicked again. This increases the time between each kick, which decreases the efficiency of the device. Other systems utilize a tether and attempt to automatically reset the ball back into its original position before being kicked or struck. These systems provide somewhat more efficiency but still suffer from drawbacks. For example, in this type of system the ball is returned to its originating location as a result of gravity. The user may still have to wait before striking the ball again due to excessive oscillation of the ball. Moreover, all of these system do not include a means for adjusting the device to accommodate both left and right footed individuals.

Therefore, there is a need in the art for a sports training apparatus configured to suspend a sports ball in a ready position for either left-footed or right-footed kicking and return the ball to the ready position after being kicked, thereby eliminating the need for retrieval of a kicked ball and the prolonged waiting period required for settling of a kicked ball into a ready position.

In light of known sports training apparatuses, it is submitted that the present invention substantially diverges in elements from the prior art and consequently it is clear that there is a need in the art for an improvement to sports training apparatuses. In this regard, the instant invention substantially fulfills these needs.

SUMMARY OF THE INVENTION

In view of the foregoing disadvantages inherent in the known types of sports training apparatuses now present in the prior art, the present invention provides an interchangeable sports ball kicking training apparatus wherein the same can be utilized for providing convenience for the user when training how to kick a particular sports ball.

In one example of the present invention, the interchangeable sports ball kicking training apparatus comprises a base including a mounting bracket for mounting the base onto a surface. A height-adjustable support arm affixed to the base includes a swivel rotatably coupled thereto. The swivel is rotatably coupled to the support arm, such that the swivel is configured to rotate 360 degrees about the support arm. A swing arm coupled to the swivel includes a quick-release mechanism configured to releasably engage a sports ball retaining bracket and a first fastener. A height-adjustable return arm includes a second fastener configured to releasably engage the first fastener of the swing arm, in order to hold the training apparatus in a ready position for kicking, and includes a return member configured to stop rotation of the swing arm and return the swing arm to the ready position.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
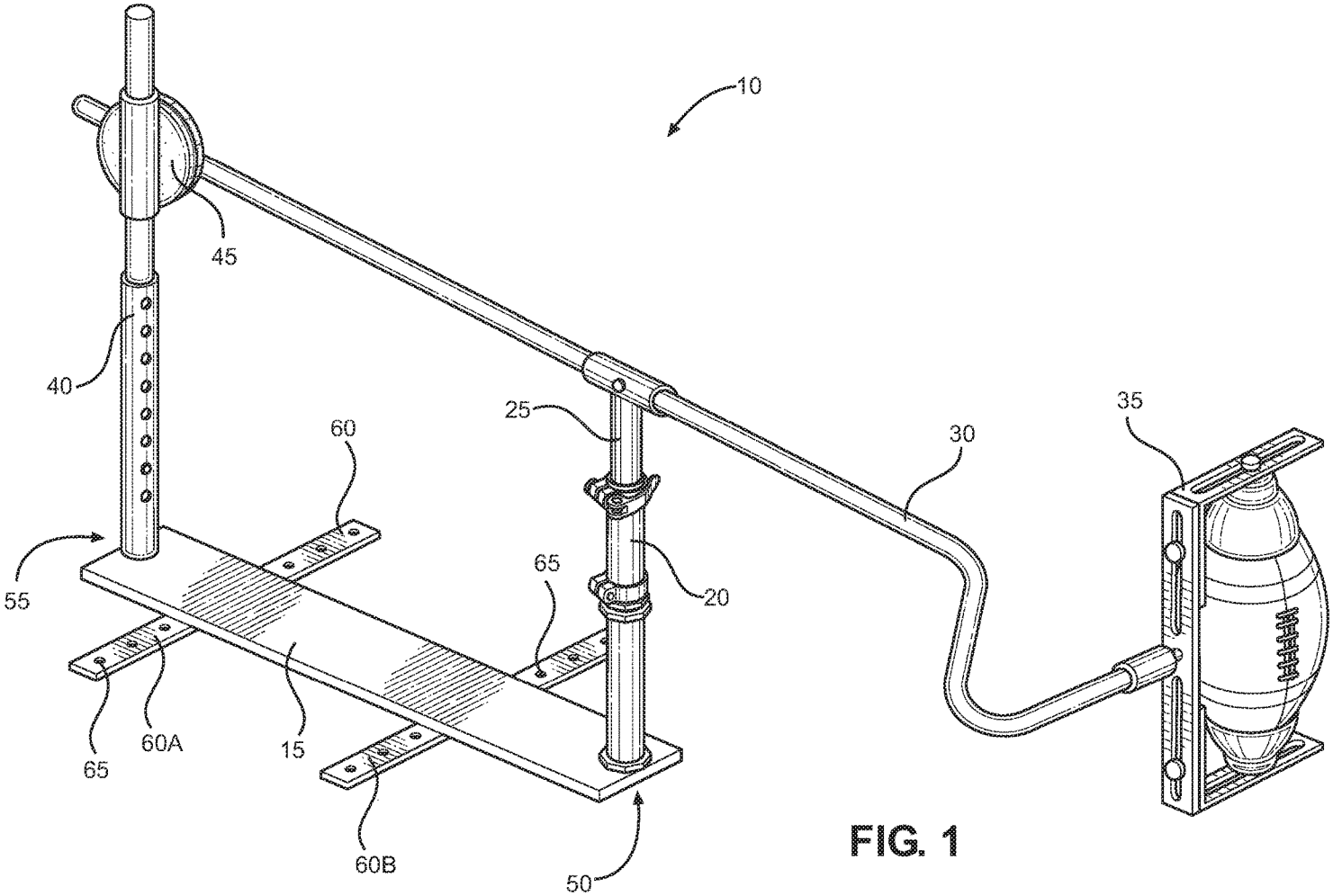
FIG. 1 shows a perspective view of the interchangeable sports ball kicking training apparatus in a ready position prior to being kicked and configured for right-footed use.

Reference is made herein to the attached drawings. Like reference numerals are used throughout the drawings to depict like or similar elements of the interchangeable sports ball kicking training apparatus. The figures are intended for representative purposes only and should not be considered to be limiting in any respect.

Figure 2:
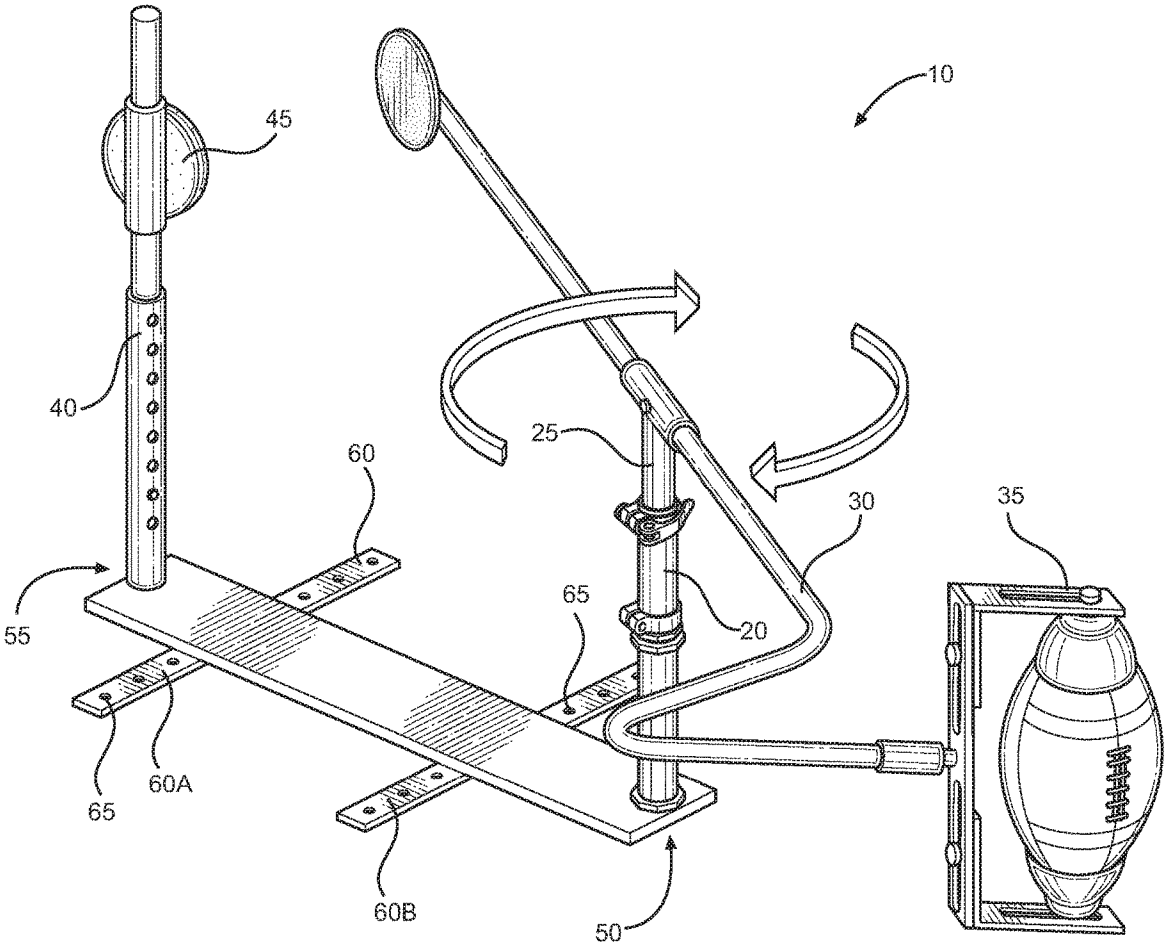
FIG. 2 shows a perspective view of the interchangeable sports ball kicking training apparatus in motion after being kicked.

Referring now to FIGS. 1 and 2, there is shown a perspective view of the interchangeable sports ball kicking training apparatus in a ready position and a perspective view of the interchangeable sports ball kicking training apparatus in motion, respectively. The present invention provides a training apparatus 10 comprising a ball retention means configured to retain a ball in a ready position for kicking, a ball return means for repositioning the ball in a ready position after being kicked, and an adjustment means for adjusting the height of the ball relative to the ground. The training apparatus 10 comprises a base 15, a support arm 20, a swivel 25 rotatably coupled to support arm 20, a swing arm 30 coupled to the swivel 25, an interchangeable ball retention bracket 35 removably attachable to the swing arm 30, a return arm 40, and a fastener 45 for releasably securing the swing arm 30 to the return arm 40 in a ready position.

The interchangeable ball retention bracket 35 is configured to removably secure a sports ball, such as a football or soccer ball, to the training apparatus 10. The fastener 45 of the return arm 40 is configured to releasably secure the swing arm 30 in a ready position, i.e., a resting or starting position in which a ball secured to the ball retention bracket 35 is ready for striking by a user. After the ball is struck, the swing arm 30 is configured to swing or rotate about the support arm 20 and strike an opposite side of the return arm 40. The return arm 40 partially absorbs the momentum of the swing arm 30 and returns the swing arm 30 back, in an opposing direction of the initial swing direction, towards the fastener 45, which then releasably secures the swing arm 30 in the ready position. In this way, the training apparatus 10 automatically returns a kicked ball to its original resting position without requiring any ball retrieval or prolonged waiting by a user.

The base 15 of the training apparatus 10 includes a planar member including a first end 50, a second end 55, and a mounting bracket 60 for mounting the training apparatus 10 to a surface, such as concrete, grass, and wood. In the depicted embodiment, the mounting bracket 60 includes a pair of elongated plates 60A, 60B affixed to a lower end of the base 15. Each of the pair of elongated plates 60A, 60B includes a plurality of apertures 65 configured to receive a fastener, such as a bolt, screw, stake, or anchor therethrough. The elongated plates 60A, 60B are aligned and positioned parallel relative to each another on the first end 50 and the second end 55, respectively, and perpendicular relative to the base 15, so as to provide the training apparatus 10 more lateral support when in use.

Figure 3:
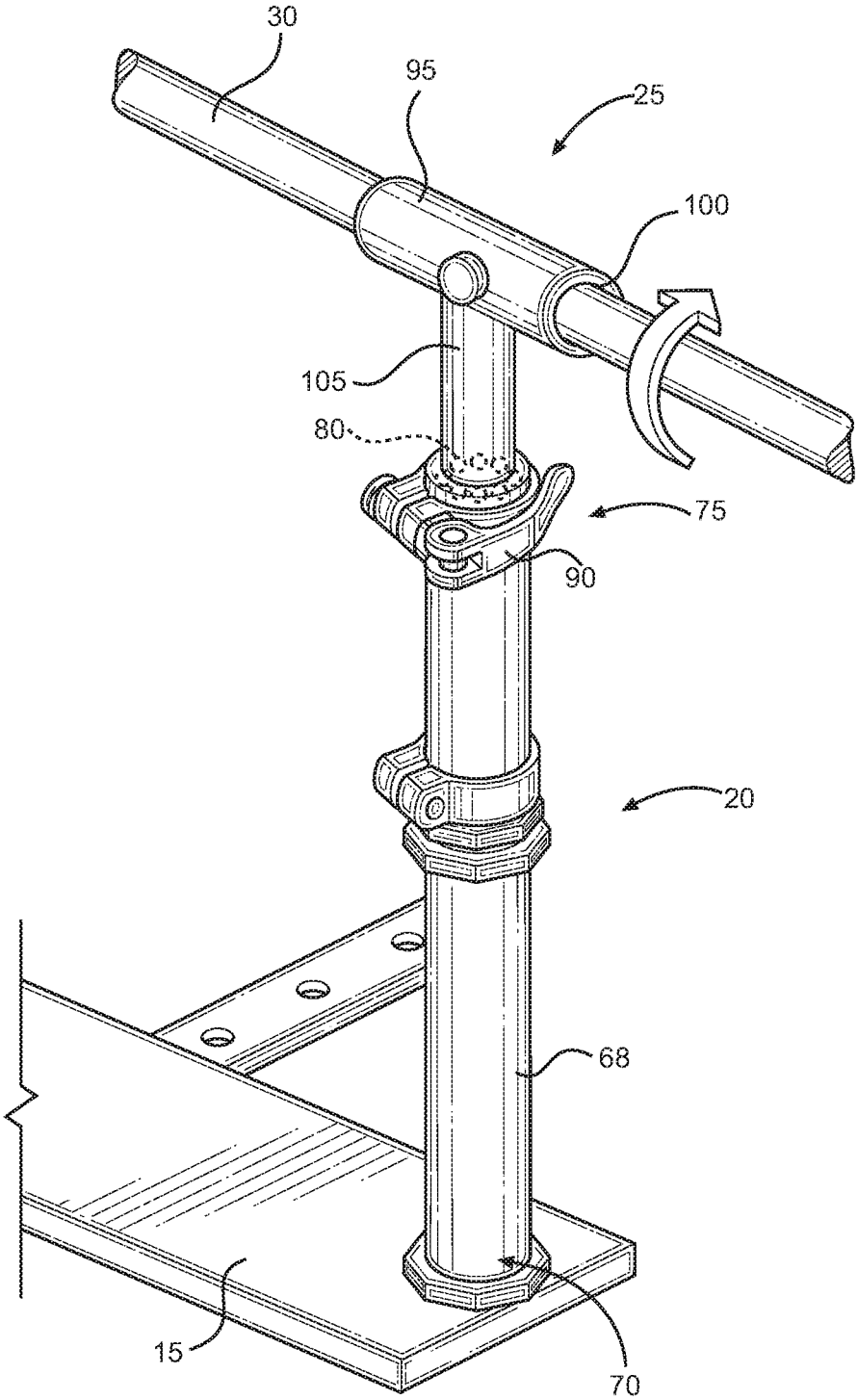
FIG. 3 shows a perspective view of the support arm of the interchangeable sports ball kicking training apparatus.
Figure 9:
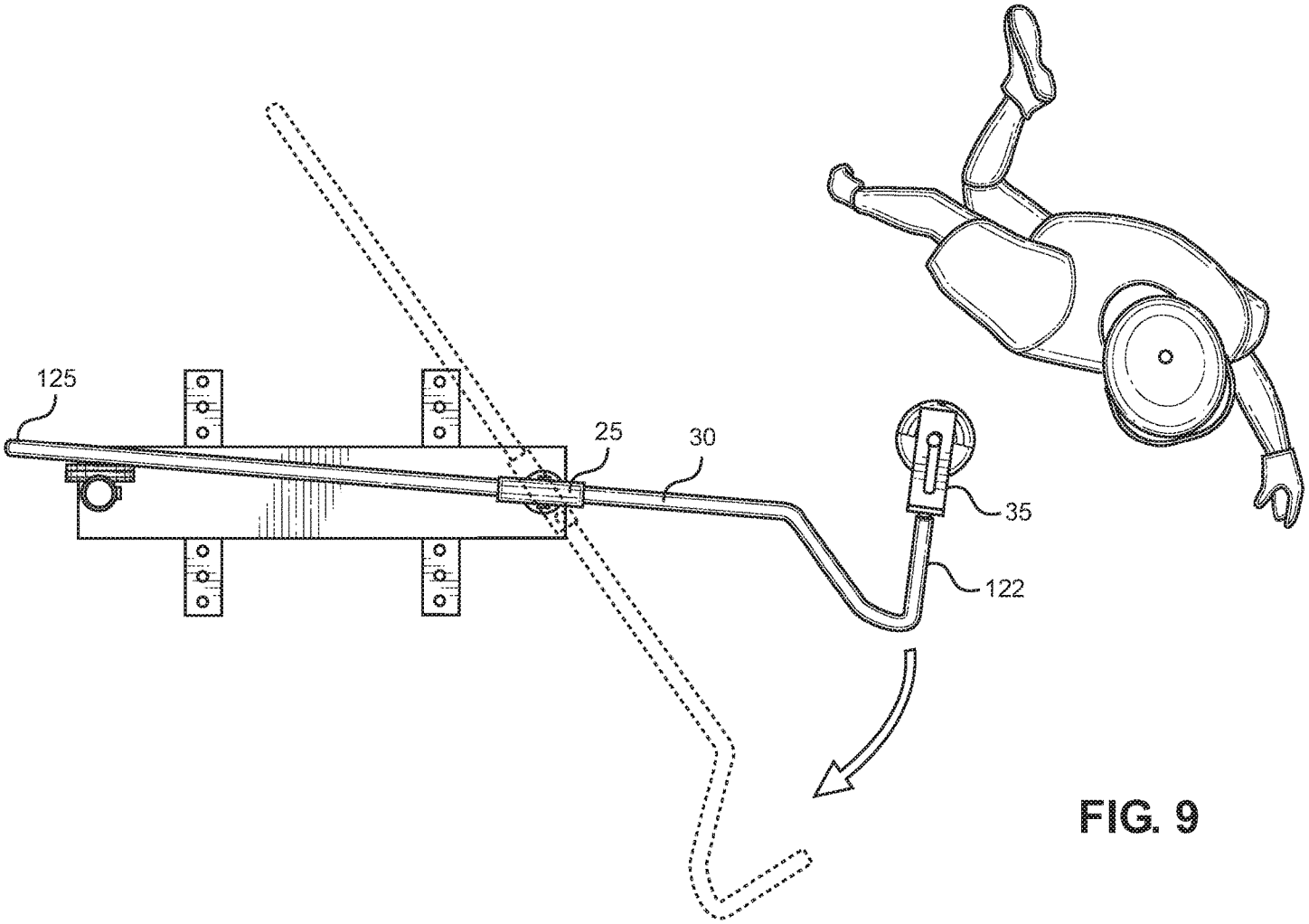
FIG. 9 shows a top plan view of the interchangeable sports ball kicking training apparatus in use.

Referring now to FIG. 3, there is shown a perspective view of the support arm of the interchangeable sports ball kicking training apparatus. The support arm 20 includes a tubular member 68 protruding vertically upwardly from the first end of the base 15. The tubular member 68 includes a first end 70 affixed to the base 15 and a second end 75 coupled to the swivel 25. The swivel 25 includes a socket member 95 including a tubular borehole 100 configured to receive the swing arm 30 therethrough, and a pivot shaft 105 slidably and rotatably disposed in the tubular member 68, thereby forming a telescopic and height-adjustable arrangement. The pivot shaft 105 is rotatably coupled to the second end 75 of the tubular member 68, such that the swivel may rotate 360 degrees about the tubular member 68. In this way, the swivel 25 is configured to rotate when a ball suspended by the interchangeable ball retention bracket 35 of the swing arm 30 is struck, as shown by FIG. 9. In one embodiment, the pivot shaft 105 is rotatably coupled to the tubular member 68 via a ball bearing mechanism 80 disposed at the second end 75. In another embodiment, the pivot shaft 105 is rotatably coupled to the tubular member 68 via a bushing disposed in the tubular member 68. In the depicted embodiment, the swivel 25 is configured to rotate about a horizontal axis that is perpendicular to a longitudinal axis of the support arm 20.

The second end 75 of the tubular member 68 further includes a clamp 90 for releasably securing the pivot shaft 105 at a desired height relative to the tubular member 68. In this way, the swivel 25 can be adjusted at a desired height relative to the base 15, allowing the swing arm 30 to be positioned at the proper height for the user to achieve a correct kicking motion. The clamp 90 secures the pivot shaft 105 in the tubular member 68 such that the pivot shaft 105 is prevented from sliding longitudinally within the tubular member 68, but not prevented from rotating laterally within the tubular member 68 via the ball bearing mechanism 80 or bushing. In the depicted embodiment, the clamp 90 includes a quick-release clamp disposed annularly about the second end 75. The quick-release clamp is configured to squeeze the tubular member 68 around the pivot shaft 105, thereby securing the pivot shaft 105 at a desired height relative to the tubular member 68.

Figure 4:
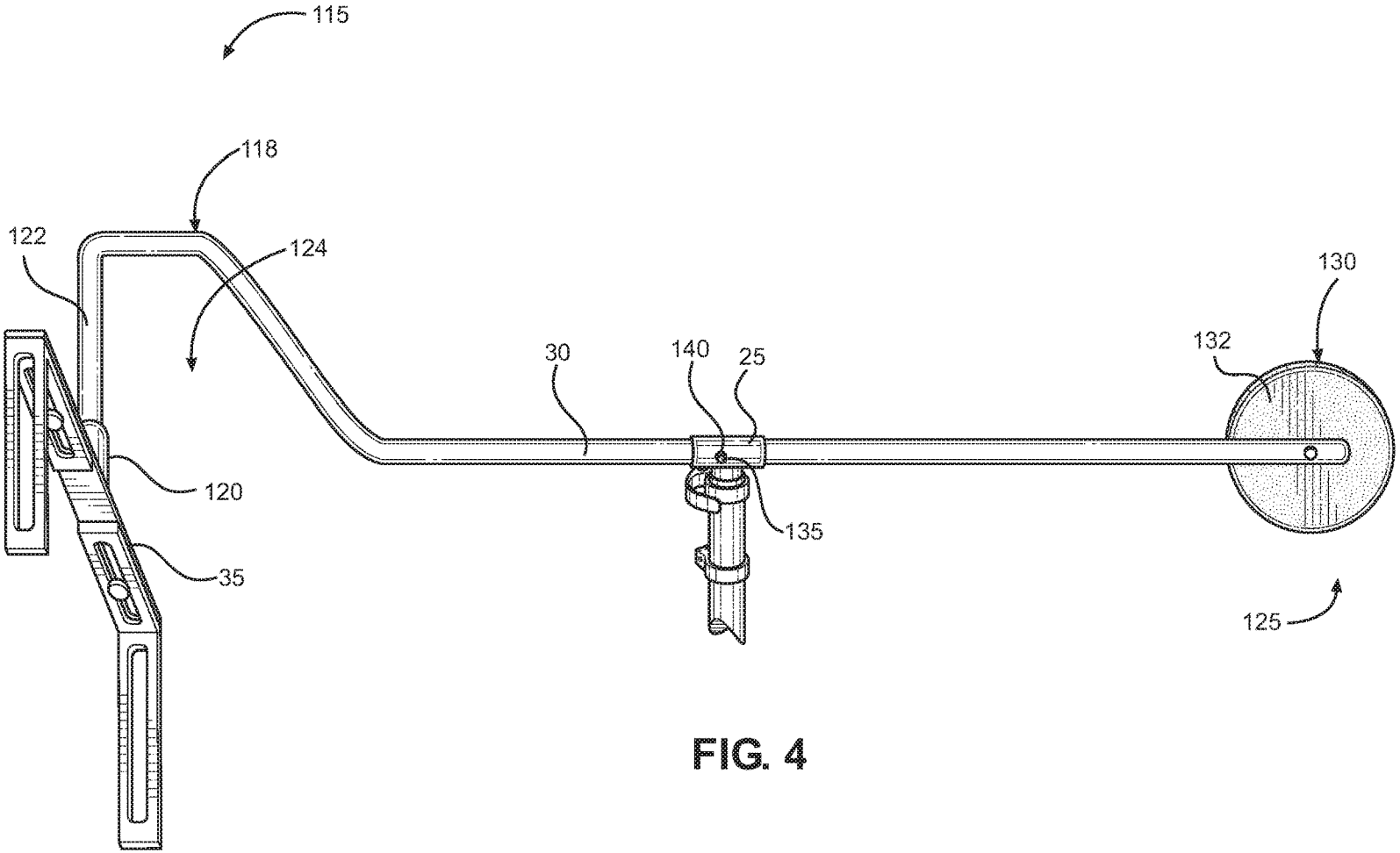
FIG. 4 shows a perspective view of the swing arm of the interchangeable sports ball kicking training apparatus.

Referring now to FIG. 4, there is shown a perspective view of the swing arm of the interchangeable sports ball kicking training apparatus. The swing arm 30 is slidably mounted onto the swivel 25 through the borehole. The swing arm 30 includes a first end 115 including a quick-release mechanism 120 configured to removably receive an interchangeable ball retention bracket 35 and a second end 125 including a fastener 130 configured to releasably engage the fastener of the return arm. In the depicted embodiment, the fastener 130 includes a magnetic member 132 affixed to the second end 125 of the swing arm 30, which is aligned with and corresponds to the fastener of the return arm. In another embodiment, the fastener 130 includes a magnetic material disposed annularly about the second end 125 of the swing arm 30.

In the depicted embodiment, the first end 115 defines an arch 118 that curves outwardly relative to a longitudinal axis of the swing arm 30 and then back inwardly towards the swing arm 30. The arch 118 includes a protruding portion 122 that is perpendicular relative to the longitudinal axis of the swing arm 30 and that protrudes outwardly, i.e., is offset, from the longitudinal axis of the swing arm 30. The protruding portion 122 includes the quick-release mechanism 120 for removably receiving the interchangeable ball retention bracket 35. The arch 118 forms a gap 124 between the swing arm 30 and the ball retention bracket 35 at the first end 115. The gap 124 is sized to provide room for a user to swing his or her foot and to prevent interference with the swing arm 30 when kicking. The protruding portion 122 of the arch 118 further prevents interference with the swing arm 30 by causing the interchangeable ball retention bracket 35 to jut outwardly in a direction perpendicular to the swing arm 30. In this way, a ball held by the interchangeable ball retention bracket 35 is positioned in such a manner that the swing arm 30 does not interfere with a user's foot trajectory, and such that the second end 125 of the swing arm 30 does not strike the user upon rotation after the ball is struck, as shown by FIG. 9.

The swing arm 30 includes a depressible biased member 135 protruding outwardly from a middle portion of the swing arm 30 that is configured to releasably engage an aperture 140 disposed on either side of the swivel 25. The biased member 135 is biased radially outwardly relative to the swing arm 30, such that the biased member 135 can be depressed radially inwardly in order to disengage the apertures 140 of the swivel 25. In this way, the swing arm 30 can rotate 180 degrees, within the borehole of the swivel 25, about a vertical axis that is parallel to the support arm 20, such that a user can change the orientation of an interchangeable ball retention bracket 35 secured to the swing arm 30 in order to accommodate both left-footed and right-footed users.

Figure 5:
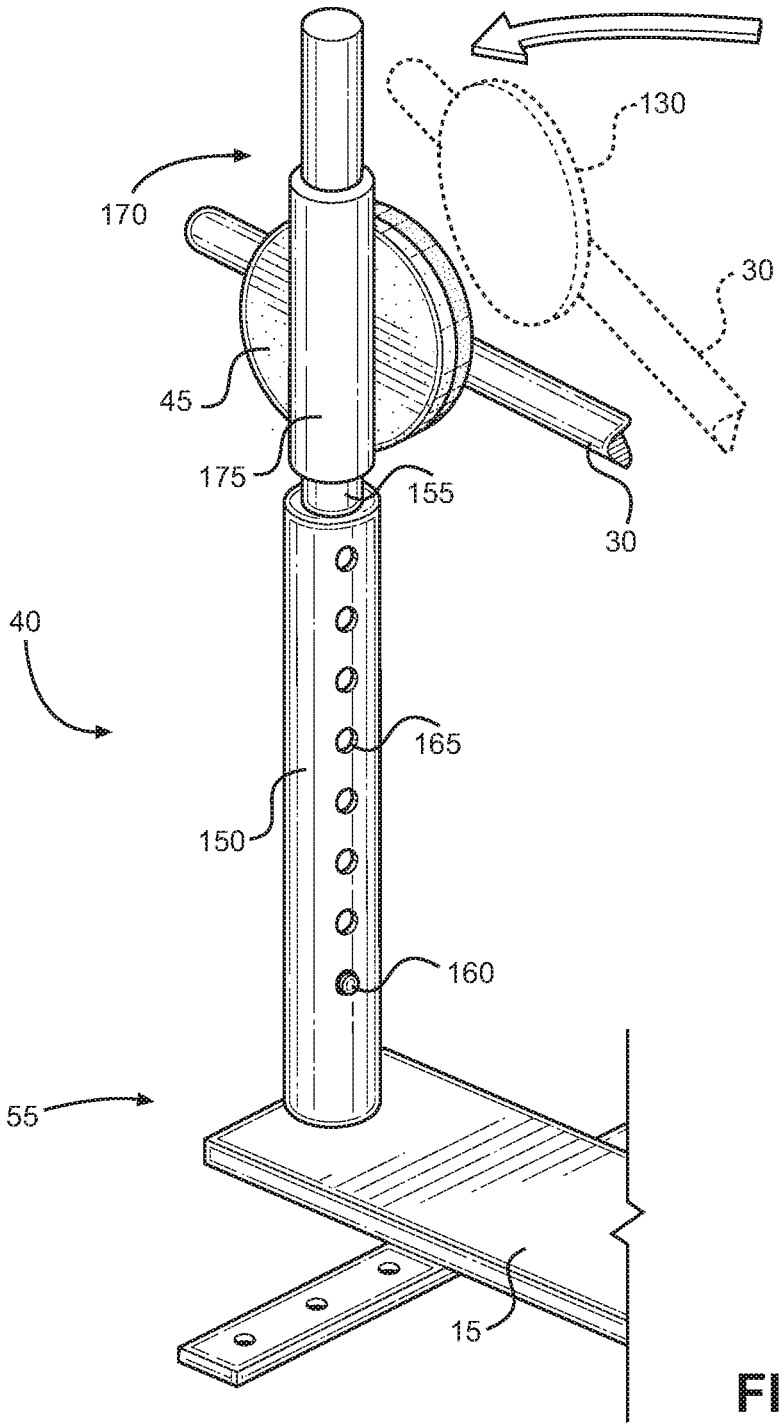
FIG. 5 shows a perspective view of the return arm of the interchangeable sports ball kicking training apparatus.

Referring now to FIG. 5, there is shown a perspective view of the return arm of the interchangeable sports ball kicking training apparatus. The return arm 40 protrudes vertically upwardly relative to the base 15 and is parallel relative to the support arm. In one embodiment, the return arm 40 is symmetrically aligned with the support arm about a center axis of the base 15. The return arm 40 includes a first member 150 affixed to the second end 55 of the base 15 and a second member 155 slidably disposed in the first member 150, thereby forming a telescopic and height-adjustable arrangement. The second member 155 includes a biased push button 160 configured to releasably engage a plurality of apertures 165 disposed longitudinally along the first member 150. The biased push button 160 is biased radially outwardly relative to the second member 155, such that it can engage each of the plurality of apertures 165 and secure the second member 155 within the first member 150. The biased push button 160 is depressible radially inwardly into the second member 155, such that it can be disengaged from each of the plurality of apertures 165 in order to adjust the height of the return arm 40 as desired. The second member 155 of the return arm 40 is completely removable from the first member 150 of the return arm 40, such that the second member 155 and fastener 45 can be rotated 180 degrees to face an opposing side. By being able to completely remove the second member 155 from the first member 150, the swing arm 30 can be repositioned on opposite sides of the return arm 40, thereby allowing the training apparatus to be reconfigured for both right-footed and left-footed users.

The fastener 45 of the return arm 40 is disposed on a distal end 170 of the second member 155. In the depicted embodiment, the fastener 45 includes a circular magnet affixed to a first side of the second member 155. The fastener 45 is configured to releasably engage the fastener 130 of the swing arm 30 to the return arm 40, thereby securing the swing arm 30 in the ready position. The second member 155 includes a return member 175 disposed on the side opposing the fastener 45. The return member 175 extends along a longitudinal length of the second member 155. The second member 155 is disposed at a height higher than a height of the swing arm 30, allowing the return member 175 to act as a stopper configured to halt the rotation of the swing arm 30 after being struck, and return the swing arm 30 back towards the fastener 45, i.e., in the direction opposing the swing, such that it can secure the swing arm 30 in the ready position. The return member 175 is composed of a flexible, elastic, and durable material, such as rubber, such that the return member 175 is configured to cushion the blow of the swing arm 30 against the return arm 40 and prevent structural damage to the return arm 40 after repeated striking of the swing arm 30.

Figure 6:
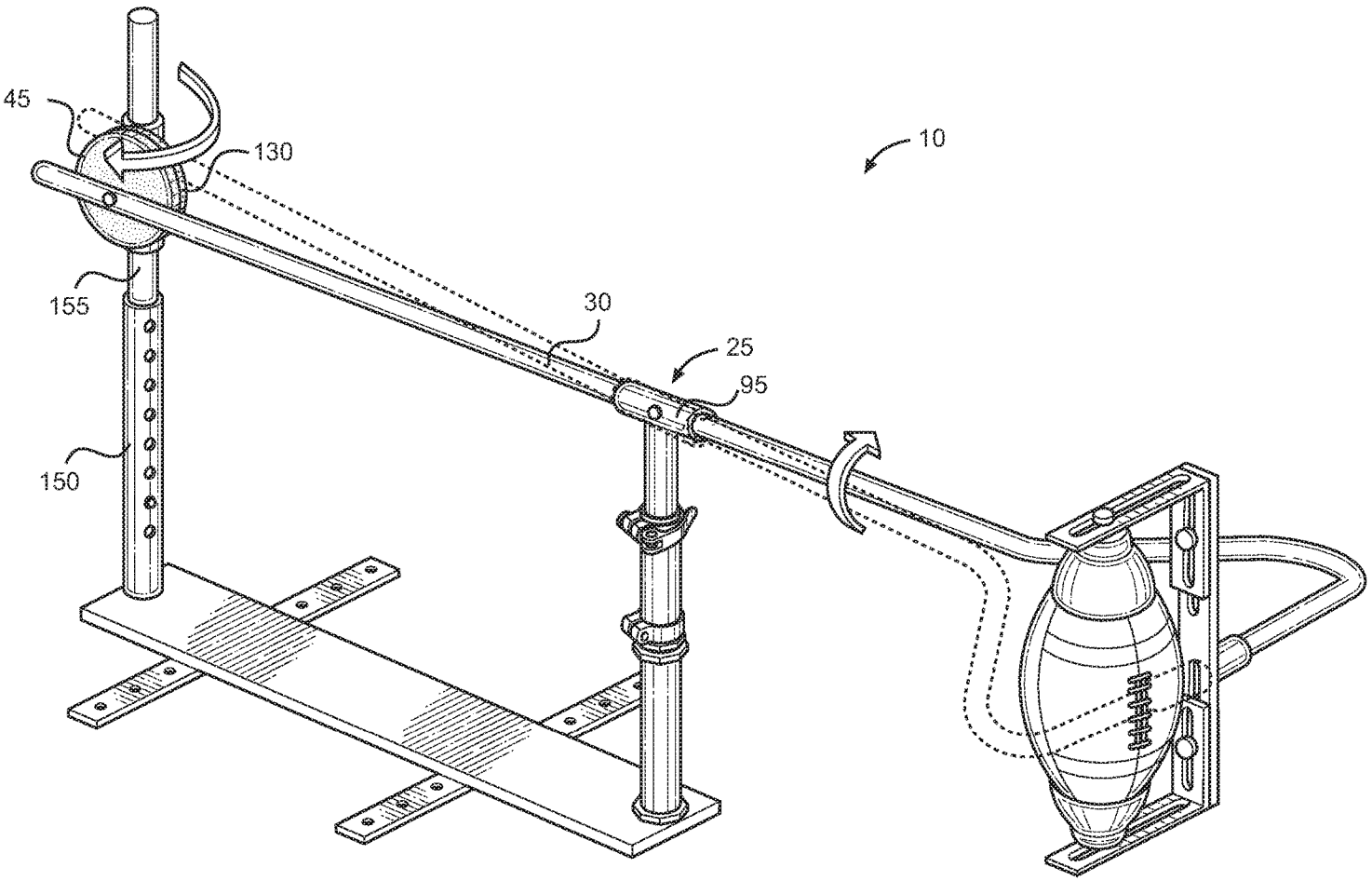
FIG. 6 shows a perspective view of the interchangeable sports ball kicking training apparatus of FIG. 1 being reconfigured for left-footed use.

Referring now to FIG. 6, there is shown a perspective view of the interchangeable sports ball kicking training apparatus of FIG. 1 being reconfigured for left-footed use. In order to adjust the training apparatus 10 such that the swing arm 30 can accommodate both left-footed and right-footed users, a user first rotates the swing arm 30 approximately 180 degrees about a longitudinal axis of the socket member 95 of the swivel 25. Next, the user slidably removes the second member 155 from the first member 150. Once the second member 155 is removed from the first member 150, a user may rotate the swing arm 30, such that the swing arm 30 crosses over the longitudinal axis of the first member 150 and is now on the opposite side on which it was previously positioned. Next, the user rotates the second member 155 approximately 180 degrees about a longitudinal axis of the first member 150, from the position in which it was previously positioned prior to being removed, such that the fastener 45 of the second member 155 is now on the same side as the swing arm 30 and aligned with the fastener 130 of the swing arm 30. Once rotated 180 degrees, the user may reinsert the second member 155 into the first member 150 and secure it thereto. This repositioning, i.e., 180 degree rotation of the swing arm 30, removal of the second member 155, and 180 rotation and reinsertion of the second member 155 into the first member 150, enables a user to reconfigure the training apparatus 10 such that it may secure a ball in a ready position that accommodates both left-footed and right-footed kicking.

Figure 7:
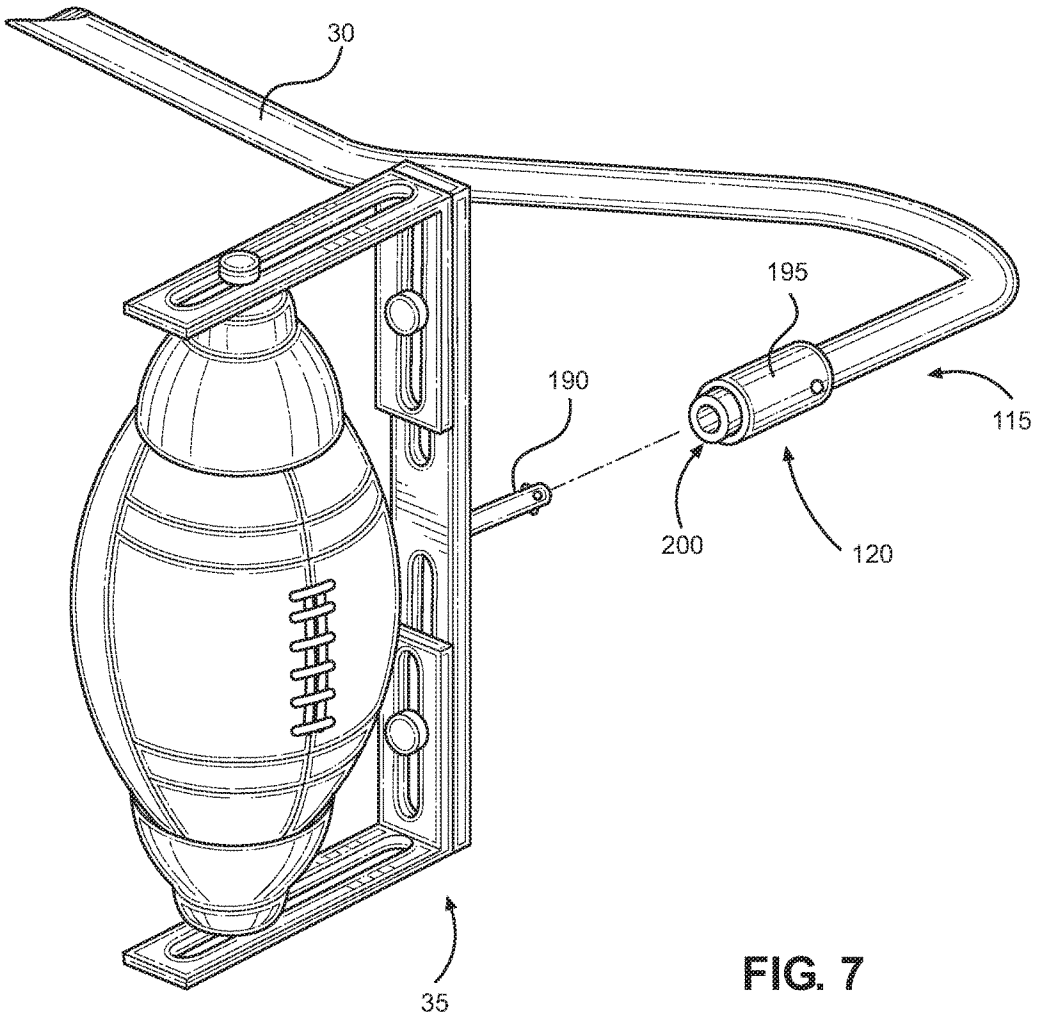
FIG. 7 shows an exploded view of the quick-release mechanism receiving the interchangeable ball retention bracket of the interchangeable sports ball kicking training apparatus.

Referring now to FIG. 7, there is shown an exploded view of the quick-release mechanism receiving the interchangeable ball retention bracket of the interchangeable sports ball kicking training apparatus. The interchangeable ball retention bracket 35 includes a shaft 190 protruding outwardly therefrom. The quick-release mechanism 120 of the swing arm 30 includes a biased collar 195 coupled to a borehole 200 that is configured to receive the shaft 190. The biased collar 195 is configured to releasably engage the shaft 190 when inserted therein. The biased collar 195 extends annularly around the first end 115 of the swing arm 30 and is slidably disposed along the length of the first end 115. The biased collar 195 is biased towards a first position, in which the biased collar 195 engages a shaft 190 inserted into the borehole 200. Longitudinal translation of the biased collar 195 towards an opposing second position releases the shaft 190 from the borehole 200, thereby allowing the interchangeable ball retention bracket 35 to be removed.

Figure 8A:
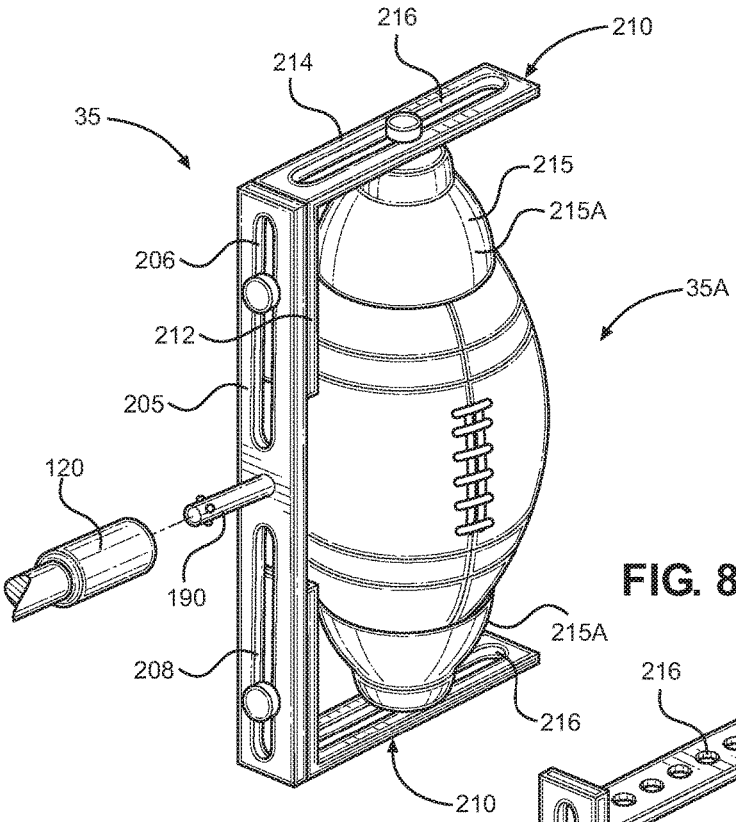
FIG. 8A shows a perspective view of a first interchangeable ball retention bracket of the interchangeable sports ball kicking training apparatus.
Figure 8B:
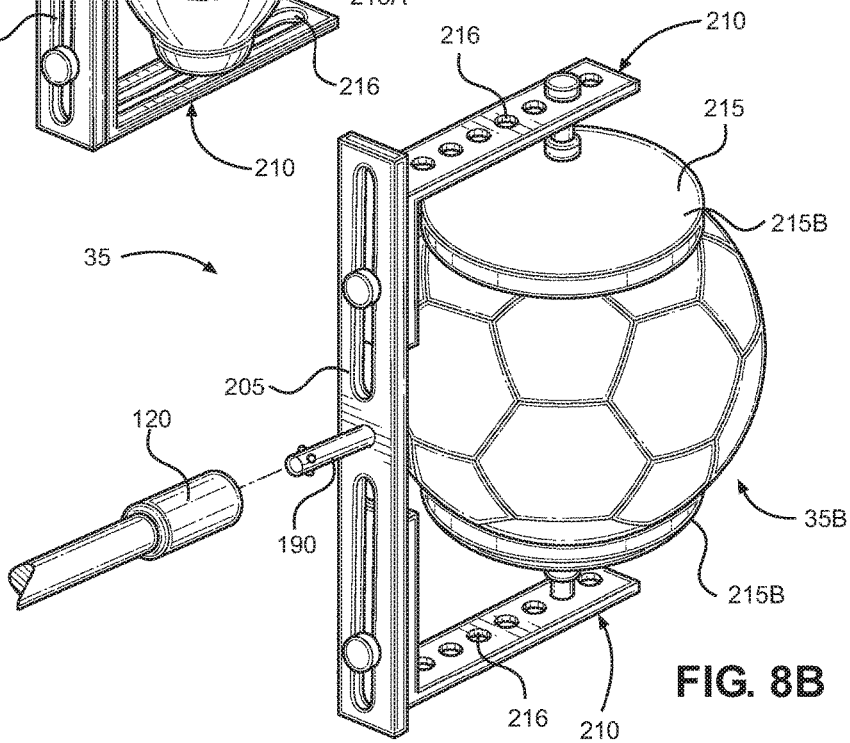
FIG. 8B shows a perspective view of a second interchangeable ball retention bracket of the interchangeable sports ball kicking training apparatus.

Referring now to FIGS. 8A and 8B, there is shown a perspective view of a first interchangeable ball retention bracket and a perspective view of a second interchangeable ball retention bracket, respectively. The interchangeable ball retention bracket 35 includes a first member 205 including a first end having a first elongated aperture 206 and a second end having a second elongated aperture 208. The first and second elongated apertures 206, 208 are each configured to receive a fastener therethrough. The shaft 190 protrudes outwardly from a center of the first member 205, such that the quick-release mechanism 120 can grasp the interchangeable ball retention bracket 35 at a center thereof, thereby balancing a sports ball positioned in the bracket 35.

A pair of opposing ball retaining members 210 are slidably disposed on the first and second ends of the first member 205. The pair of ball retaining members 210 include a first portion 212 and a second portion 214 each including an elongated aperture 216 extending along the linear length thereof. The elongated apertures of the first and second portions 212, 214 are each configured to receive a fastener therethrough. The first portions 212 are positioned parallel relative to the first member 205, while the second portions 214 protrude horizontally outwardly relative to first member 205, such that they are approximately perpendicular to the first member 205.

The elongated apertures of the first portions 212 correspond to the elongated apertures 206, 208 of the first and second ends of the first member 205, such that they are aligned. In this way, the pair of opposing ball retaining members 210 are slidably adjustable along the first and second apertures 206, 208, such that the pair of opposing ball retaining members 210 can be adjusted relative to each other in order to grasp differently sized sports balls positioned therebetween.

A pair of receptacles 215 are slidably disposed along the elongated aperture 216 of the second portions 214. In this way, the pair of receptacles 215 may be adjusted outwardly relative to the first member 205, such that a user may reposition a sports ball within the bracket 35. In one embodiment, the pair of receptacles 215 include a pair of cups 215A, as shown in FIG. 8A, that are each sized to receive the ends of a football. In another embodiment, the pair of receptacles 215 include a pair of saucers 215B, as shown in FIG. 8B, that are each sized to receive a rounded side of a soccer ball flush therein. In yet another embodiment, the training apparatus 10 includes a first interchangeable retention bracket 35A and a second interchangeable retention bracket 35B, such that a user may interchange the training apparatus 10 with a bracket including either a football or a soccer ball.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sports training apparatus, comprising:

a base including a first end, a second end, an upper end, and a lower end including a mounting bracket for mounting the base onto a surface;

a height-adjustable support arm including a first end affixed to the first end of the base and a second end including a swivel, the support arm extending vertically upwardly from the base;

the swivel rotatably coupled to the second end of the support arm, such that the swivel is configured to rotate 360 degrees about the support arm;

a swing arm rotatably coupled to the swivel, the swing arm including a first end having a quick-release mechanism configured to releasably engage a sports ball retaining bracket and a second end having a first fastener;

a height-adjustable return arm including a first end affixed to the second end of the base and a second end including a second fastener configured to releasably engage the first fastener of the swing arm in a ready position and a return member configured to stop rotation of the swing arm and return the swing arm to the ready position, the height-adjustable return arm extending vertically upwardly from the base.

2. The sports training apparatus of claim 1, wherein the mounting bracket comprises a pair of elongated plates affixed to the lower end of the of the base, each of the elongated plates including an aperture configured to receive a fastener therethrough for mounting the base to a surface.

3. The sports training apparatus of claim 2, wherein the pair or elongated plates are positioned perpendicular to the base and aligned parallel relative to each other.

4. The sports training apparatus of claim 1, wherein:

the height-adjustable return arm comprises a tubular member including a first end affixed to the base and a second end including a clamp;

the swivel comprises a pivot shaft slidably disposed in the tubular member and a socket member including a borehole configured to receive the swing arm therethrough;

the pivot shaft rotatably coupled to the second end of the tubular member, such that the swivel is configured to rotate 360 degrees about the second end of the tubular member;

the clamp configured to releasably secure the pivot shaft in the tubular member, such that the pivot shaft is prevented from moving longitudinally along the tubular member, but is able to rotate laterally about the second end of the tubular member.

5. The sports training apparatus of claim 4, wherein a ball bearing mechanism rotatably couples the pivot shaft to the second end of the tubular member.

6. The sports training apparatus of claim 4, wherein a bushing rotatably couples the pivot shaft to the second end of the tubular member.

7. The sports training apparatus of claim 4, wherein the clamp comprises a quick-release clamp disposed annularly about the second end of the support arm, the quick-release clamp configured to squeeze the tubular member around the pivot shaft, thereby preventing longitudinal movement of the pivot shaft within the tubular member.

8. The sports training apparatus of claim 1, wherein the swing arm is slidably mounted onto the swivel, the swing arm including a depressible biased member configured to releasably engage an aperture of the swivel, thereby facilitating rotation of the swing arm within the swivel.

9. The sports training apparatus of claim 1, wherein the swing arm is configured to rotate 360 degrees about an axis perpendicular to a longitudinal axis of the support arm.

10. The sports training apparatus of claim 1, wherein the first fastener of the swing arm includes a magnetic member affixed to the second end of the swing arm, the magnetic member aligned with and corresponding to the second fastener of the return arm.

11. The sports training apparatus of claim 1, wherein the first end of the swing arm defines an arch curving outwardly relative to a longitudinal axis of the swing arm, the arch including a protruding portion including the quick-release mechanism, the protruding portion configured to form a gap between the swing arm and the sports ball retaining bracket.

12. The sports training apparatus of claim 11, wherein the protruding portion is disposed perpendicular relative to the longitudinal axis of the swing arm and is offset relative to the longitudinal axis of the swing arm, thereby causing the sports ball retaining bracket attached to the quick-release mechanism to protrude perpendicularly outwardly relative to the swing arm.

13. The sports training apparatus of claim 1, wherein:

the height-adjustable return arm includes a first member affixed to the base and a second member slidably disposed within the first member, the second member including a biased push button configured to releasably engage a plurality of apertures disposed longitudinally along the first member, thereby facilitating longitudinal adjustment of the second member along the first member and complete removal of the second member from the first member;

wherein the second member includes the second fastener and the return member disposed on opposing sides thereof;

wherein the second member includes a height larger than a height of the swing arm.

14. The sports training apparatus of claim 1, wherein the second fastener of the second member includes a magnetic member aligned with and corresponding to the first fastener of the swing arm.

15. The sports training apparatus of claim 1, wherein the return member is composed of a flexible and elastic material extending along a longitudinal length of the second member.

16. The sports training apparatus of claim 1, wherein the sports ball retaining bracket includes a first member including shaft protruding outwardly therefrom, a first end, a second end, and a pair of opposing ball retaining members slidably disposed on the first end and the second end of the first member, respectively, each of pair of opposing ball retaining members including a receptacle slidably adjustable along a length thereof, the receptacles configured to removably receive a sports ball therein, wherein the pair of opposing ball retaining members protrude outwardly from the first member in a direction opposing the shaft.

17. The sports training apparatus of claim 16, wherein the receptacles include cups configured to receive the ends of a football flush therein.

18. The sports training apparatus of claim 16, wherein the receptacles include saucers configured to receive the ends of a soccer ball flush therein.

19. The sports training apparatus of claim 16, comprising:

a first sports ball retaining bracket including a pair of opposing ball retaining members, each of the pair of opposing ball retaining members including a cup, the cups configured to receive the ends of a football; and a second sports ball retaining bracket including a pair of opposing ball retaining members, each of the pair of opposing ball retaining members including a saucer, the saucers configured to receive the ends of a soccer ball;

wherein the first sports ball retaining bracket is interchangeable with the second sports ball retaining bracket.

20. The sports training apparatus of claim 16, wherein the quick-release mechanism comprises:

a borehole configured to receive the shaft of the sports ball retaining bracket;

a biased collar coupled to the borehole, the biased collar extending annularly about the first end of the swing arm, the swing arm biased towards a first position and slidable along a length of the first end towards a second position;

wherein the biased collar is configured to engage the shaft in the first position;

wherein the biased collar is configured to release the shaft in the second position.

* * * * *